US005657901A

United States Patent [19]

Farside

[11] Patent Number: 5,657,901

[45] Date of Patent: Aug. 19, 1997

[54] TABLET DISPENSER WITH CHILD-RESISTANT LOCKING FEATURE

[75] Inventor: Nicholas Farside, East Petersburg, Pa.

[73] Assignee: Kerr Group, Inc., Lancaster, Pa.

[21] Appl. No.: 596,934

[22] Filed: Feb. 5, 1996

[51] Int. Cl.[6] ..... B65G 59/00

[52] U.S. Cl. ..... 221/152; 221/264

[58] Field of Search ..... 221/151, 152, 221/263, 264, 289, 154

[56] References Cited

U.S. PATENT DOCUMENTS

| | | | |
|---|---|---|---|
| 2,683,554 | 7/1954 | Mulhauser | 221/152 |
| 3,355,067 | 11/1967 | Espinal | 222/23 |
| 3,833,147 | 9/1974 | Borsum et al. | 221/202 |
| 4,230,236 | 10/1980 | Boulter | 221/190 |
| 4,354,619 | 10/1982 | Wippermann et al. | 221/263 |
| 4,405,060 | 9/1983 | Hsei | 221/135 |
| 4,415,098 | 11/1983 | Haas | 221/202 |
| 4,492,316 | 1/1985 | Emms | 221/202 |
| 4,564,124 | 1/1986 | Burton | 221/263 |
| 4,653,668 | 3/1987 | Gibilisco et al. | 221/298 |
| 4,767,023 | 8/1988 | Hackmann et al. | 221/152 |
| 4,854,478 | 8/1989 | Gyimothy | 221/190 |
| 5,108,006 | 4/1992 | Tieke et al. | 221/152 |
| 5,174,471 | 12/1992 | Kozlowski et al. | 221/154 |
| 5,372,267 | 12/1994 | Hofmann | 215/220 |
| 5,383,559 | 1/1995 | Toren | 206/533 |
| 5,431,283 | 7/1995 | Weinstein et al. | 206/531 |

*Primary Examiner*—Kenneth Noland
*Attorney, Agent, or Firm*—Kenyon & Kenyon

[57] ABSTRACT

A dispenser of dispensing tablets one at a time which includes a feature which prevents children from dispensing tablets. The dispenser has a reservoir and a moving slider member that can be moved from a non-dispensing position to a dispensing position, after an locking pin or detent is unlocked. The unlocking pin or detent is mounted on a movable thumbpad, which requires the application of upward force to unlock the locking pin or detent from a locking hole or recess. The slider member has a chamber which holds only one tablet, which chamber moves from a position where the tablet is blocked from dropping from the chamber to a position where the chamber is aligned with a dispensing opening. In the dispensing position, the tablet in the chamber is dispensed, whereas the remaining tablets in the dispenser prevented from entering the chamber by a wall on the slider member.

12 Claims, 5 Drawing Sheets

TABLET DISPENSER WITH CHILD-RESISTANT LOCKING FEATURE

BACKGROUND OF THE INVENTION

1. Field of the Invention

The present invention relates to containers for the storage and dispensing of tablets, such as medicinal tablets or food tablets requiring a child-proof dispenser, such as, e.g., iron tablets. In order that the dose can be controlled, a dispenser is required which dispenses tablets one at a time. The present invention provides such a dispenser. In addition, the present invention provides a locking feature which makes the dispensing mechanism resistant to operation by children, thereby preventing access by children to the contents of the dispenser.

2. Description of the Prior Art

A prior art tablet dispenser is shown in FIGS. 10 and 11. The dispenser includes three parts which are produced from plastic materials, for example by injection molding. These parts are a body portion 1, lid portion 2, and a slider portion 4.

The lid portion 2 interengages with the upper open end of the body portion 1 and lid portion 2 may be molded in one piece and connected by an integrally molded hinge portion (not shown). The body portion 1 has a peripheral wall 5 and a base 6 having a tablet dispensing opening 7. An opening 8 in the peripheral wall 5 is provided to enable the slider portion 4 to be manipulated the assembled dispenser is in use. The body portion 1 may be made of any suitable plastic material.

The body portion 1 includes a flat lower wall 100, which, together with the front wall 5*a*, rear wall 5*c*, side walls 5*b* and lid portion 2 define a reservoir 11 in which a supply of tablets to be dispensed can be stored. The lower end of the reservoir 11 includes a rectangular slot 11*a* leading to sloping projections 12, 12'. Sloping projections 12, 12' and side walls 12" define a rectangular slot 11*a* in the base of the reservoir 11 through which pass the tablets to be dispensed. Sloping projections 12, 12' lead to a tablet outlet 13, defined by four vertical walls.

The slider portion 4 is mounted within body portion 1 by sliding it through opening 8 in body portion 1. A thumbpad 200 on slider portion 4 fills opening 8 and allows slider portion 4 to be pushed inwardly by a user's thumb or finger. Slider portion 4 includes a tablet chamber 26 defined by four vertical walls 26*a*. Tablet chamber 26 is sized so that only one tablet T can fit inside tablet chamber 26. Slider portion 4 also includes two spring fingers 300, one on each side of slider portion 4. Spring fingers 300 are molded integrally at one end 301 to slider portion 4, and contact vertical walls 400 of body portion 1 at an opposite end 302. Slider portion 4 finally includes a retaining latch 500 which engages a lower end of the rear vertical wall 13*a* defining tablet outlet 13 to retain slider portion 4 in body portion 1. Retaining latch 500 can be angled at one end to allow it to snap under rear vertical wall 13*a* on first insertion of slider portion 4 into body portion 1.

FIGS. 10 and 11 show operation of the prior art device. In the position in FIG. 10, a tablet T is held in tablet chamber 26 and is prevented from exiting tablet chamber 26 by the base 6. Thumb or finger pressure in the direction P against thumbpad 200 causes slider portion 4 to slide to the right (in FIGS. 10 and 11), against the bias of spring fingers 300 pushing against vertical walls 400. The slider portion 4 thus slides to the position of FIG. 11, such that tablet chamber 26 is immediately above tablet dispensing opening 7. Tablet T contained within tablet chamber 26 thereafter falls from tablet chamber 26 under the force of gravity, and thus the dispenser dispenses a single tablet in the direction D. An upper wall 501 on slider portion 4 closes off tablet outlet 13, to thereby prevent additional tablets in body portion 1 from being dispensed from the dispenser. Thumb or finger pressure is then released from thumbpad 200. The biasing force of spring fingers 300 causes slider portion 4 to move opposite the direction P, returning the slider portion 4 to the position of FIG. 10. In this position, a tablet T can drop into tablet chamber 26 from tablet outlet 13 for subsequent dispensing, as described above.

SUMMARY OF THE INVENTION

The present invention provides a mechanism which makes a dispenser resistant to operation by a child. The dispenser itself includes an outer casing containing a reservoir in which the tablets are stored and an apparatus for causing the tablets to be dispensed one at a time. The dispenser also includes a slider mechanism having a portion which defines a tablet chamber holding one tablet and which is moveable within the outer casing from a first position, in which the tablet chamber is open to the stored tablets, and a second tablet dispensing position, in which a single tablet in the tablet chamber is aligned with a dispensing opening in the outer casing. The slider mechanism is provided with a mechanism whereby it is urged towards the first position, and a locking pin or detent which locks in a locking hole or recess in the container to prevent movement of the slider. A thumb- or finger-actuated unlocking pad may be depressed to unlock the locking pin or detent and allow the slider to reciprocate to dispense tablets.

The device for urging the slider mechanism towards the first position may be a integrally-formed resilient spring fingers on the slider mechanism.

The lid for the container may be joined to the container via an integrally-molded flexible hinge.

BRIEF DESCRIPTION OF THE DRAWINGS

The invention will be illustrated by the following description of an embodiment thereof which is given by way of example only and has reference to the accompanying drawings in which.

DETAILED DESCRIPTION OF THE INVENTION

Figure 1:
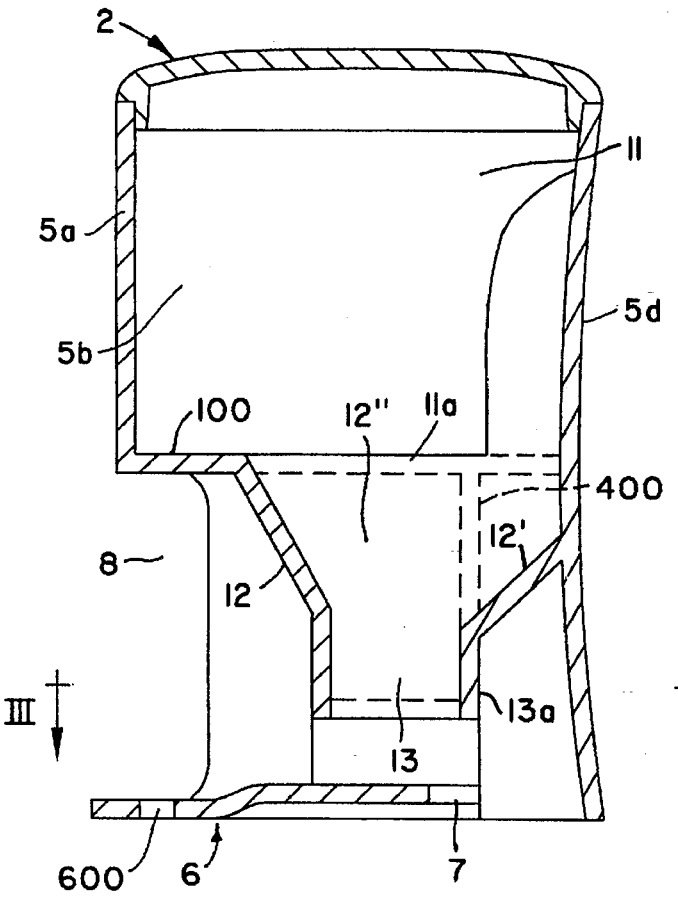
FIG. 1 is a cross-sectional side view, along line I—I of FIG. 3, of the body portion and lid of one embodiment of the present invention.
Figure 2:
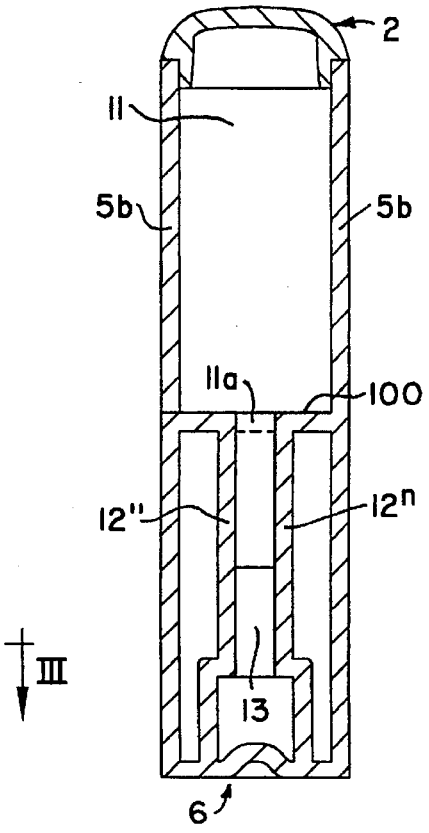
FIG. 2 is a cross-sectional rear view, along line II—II of FIG. 3, of the embodiment of FIG. 1.
Figure 3:
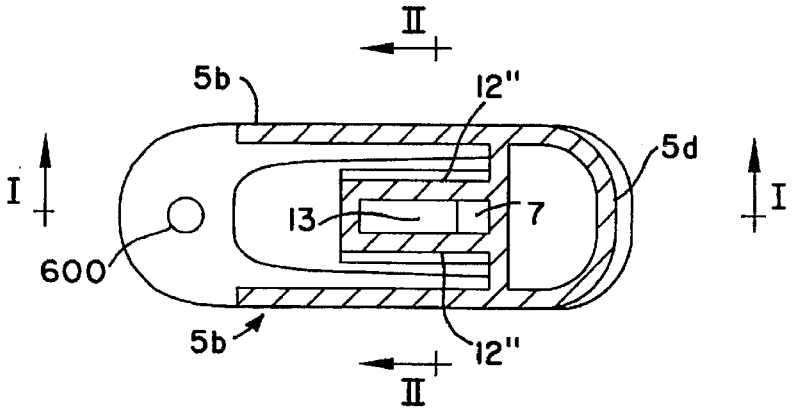
FIG. 3 is a cross-sectional top view, along line III—III of FIG. 1, of the embodiment of FIG. 1.
Figure 7:
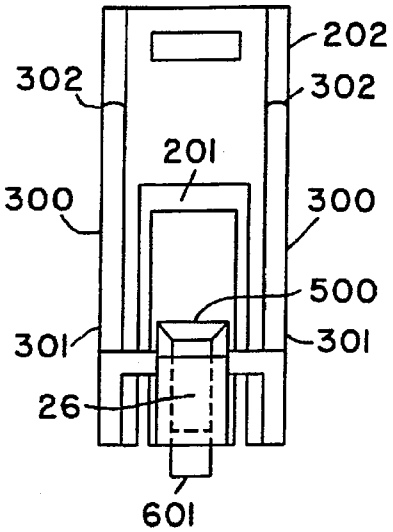
FIG. 7 is a rear view, along line VII—VII of FIG. 4, of the embodiment of FIG. 4.
Figure 4:
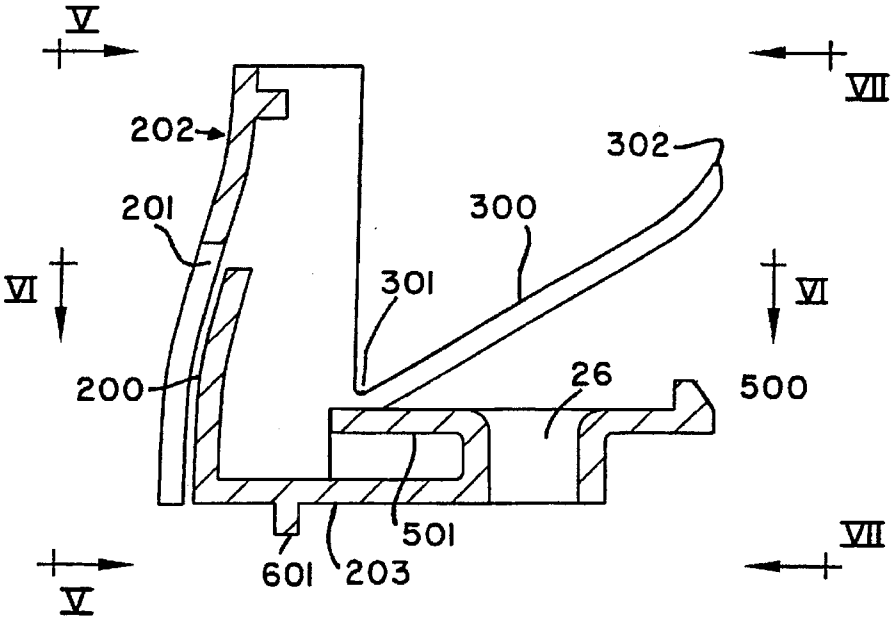
FIG. 4 is a cross-sectional side view, along line IV—IV of FIG. 6, of the slider portion of one embodiment of the present invention.
Figure 5:
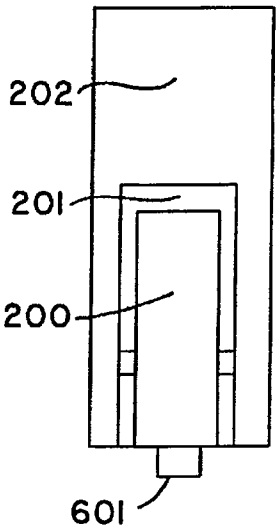
FIG. 5 is a front view, along line V—V of FIG. 4, of the embodiment of FIG. 4.
Figure 6:
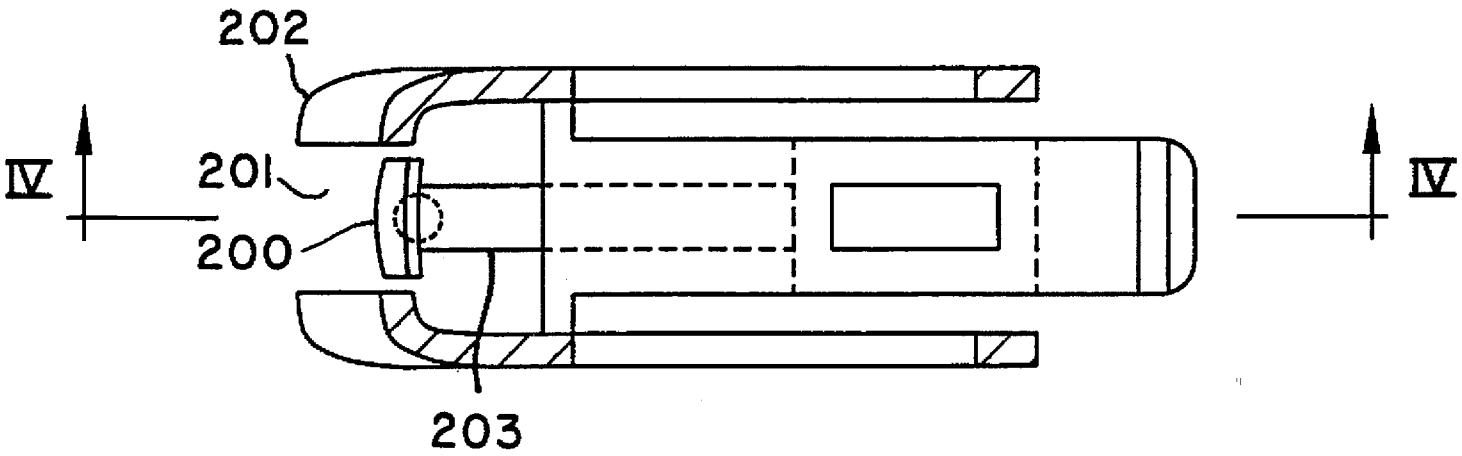
FIG. 6 is a cross-sectional top view, along line VI—VI of FIG. 4, of the embodiment of FIG. 4.

The dispenser of the present invention includes three parts which are produced from plastic materials, for example by injection molding. These parts are a body portion 1, lid portion 2, and a slider portion 4.

The lid portion 2 interengages with the upper open end of the body portion 1 and lid portion 2 may be molded in one piece and connected by an integrally molded hinge portion (not shown). The body portion 1 has a peripheral wall 5 and a base 6 having a tablet dispensing opening 7 and a locking hole or recess 600. An opening 8 in the peripheral wall 5 is provided to enable the slider portion 4 to be manipulated when the assembled dispenser is in use. The body portion 1 may be made of any suitable plastic material.

The body portion 1 includes a flat lower wall 100, which, together with the front wall 5*a*, rear wall 5*c*, side walls 5*b* and lid portion 2 define a reservoir 11 in which a supply of tablets to be dispensed can be stored. The lower end of the reservoir 11 includes a rectangular slot 11*a* leading to sloping projections 12, 12'. Sloping projections 12, 12' and side walls 12" define rectangular slot 11*a* in the base of the reservoir 11 through which pass the tablets to be dispensed. Sloping projections 12, 12' lead to a tablet outlet 13, defined by four vertical walls.

Figure 9:
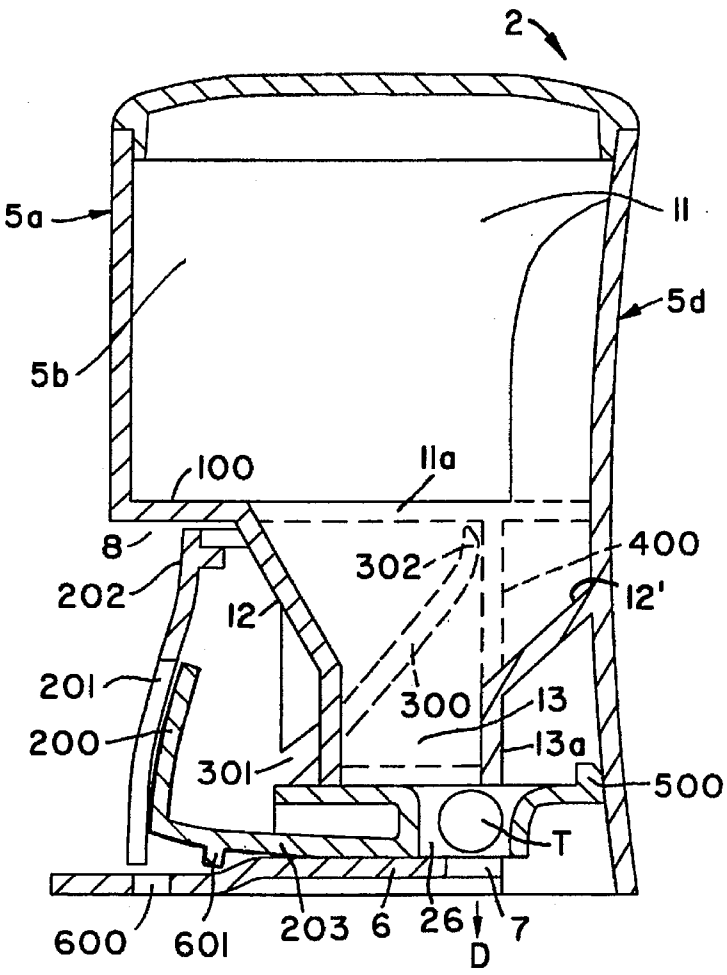
FIG. 9 is a cross-sectional assembly view of an embodiment of the present invention, in a dispensing position.
Figure 8:
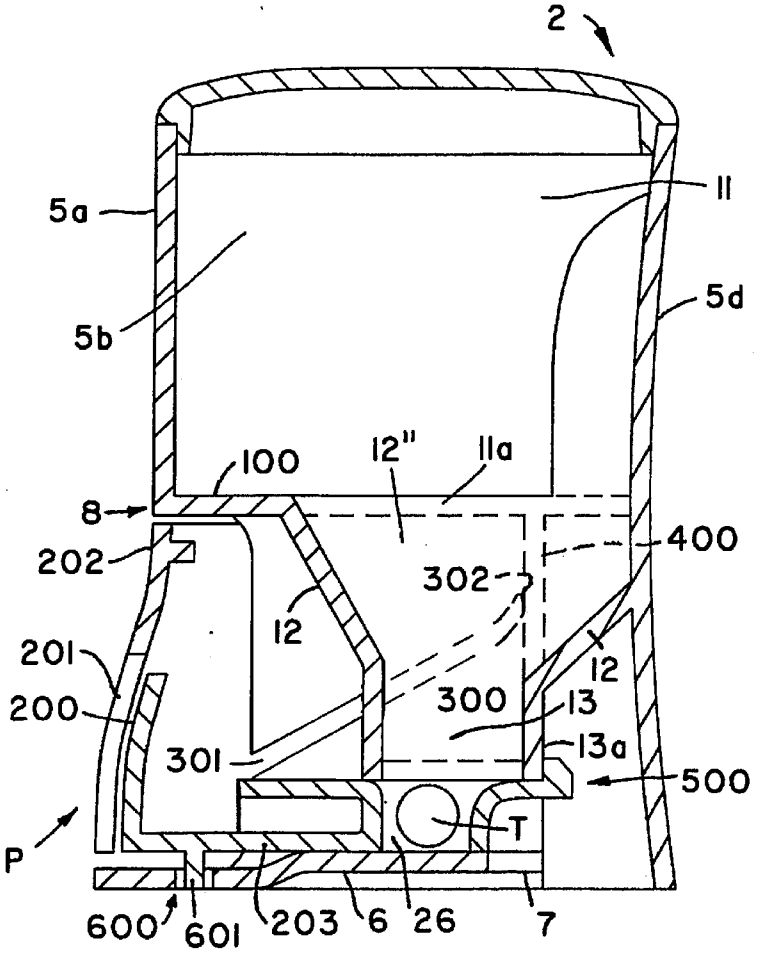
FIG. 8 is a cross-sectional assembly view of an embodiment of the present invention, in a non-dispensing position.

The slider portion 4 is mounted within body portion 1 by sliding it through opening 8 in body portion 1. A thumbpad 200 on slider portion 4 faces a thumbpad opening 201 in the front face 202 of slider portion 4. Thumbpad may be recessed from the front face 202 of slider portion 4 (as shown in FIGS. 8 and 9), or may be flush with the front face of slider portion 4. Thumbpad 200 is mounted on a cantilevered thumbpad spring section 203. A locking pin or detent 601 is fixed to an underside of thumbpad spring section 203. Thumbpad spring section 203 allows thumbpad 200 to by flexed upwardly, to thereby raise locking pin or detent upwardly, upon application of upward force on thumbpad 200. Thumbpad 200 also allows slider portion 4 to be pushed inwardly by a user's thumb or finger, upon unlocking of locking pin or detent 601 from locking hole or recess 600 and application of inward force on thumbpad 200. Slider portion 4 includes a tablet chamber 26 defined by four vertical walls 26*a*. Tablet chamber 26 is sized so that only one tablet T can fit inside tablet chamber 26. Slider portion 4 also includes two spring fingers 300, one on each side of slider portion 4. Spring fingers 300 are molded integrally at one end 301 to slider portion 4, and contact vertical walls 400 of body portion 1 at an opposite end 302. Slider portion 4 finally includes a retaining latch 500 which engages a lower end of the rear vertical wall 13*a* defining tablet outlet 13 to retain slider portion 4 in body portion 1. Retaining latch 500 can be angled at one end to allow it to snap under rear vertical wall 13*a* on first insertion.

FIGS. 8 and 9 show operation of one embodiment of the present invention. In the position in FIG. 8, a tablet T is held in tablet chamber 26 and is prevented from exiting tablet chamber 26 by the base 6. Slider portion 4 is prevented from moving inwardly as a result of the locking of locking pin or detent 601 in locking hole or recess 600. Therefore, direct inward (horizontal) thumb or finger pressure on thumbpad 200, or on front face 202 of slider portion 4, will not allow sliding of slider portion 4 to thereby dispense a tablet T.

Figure 11:
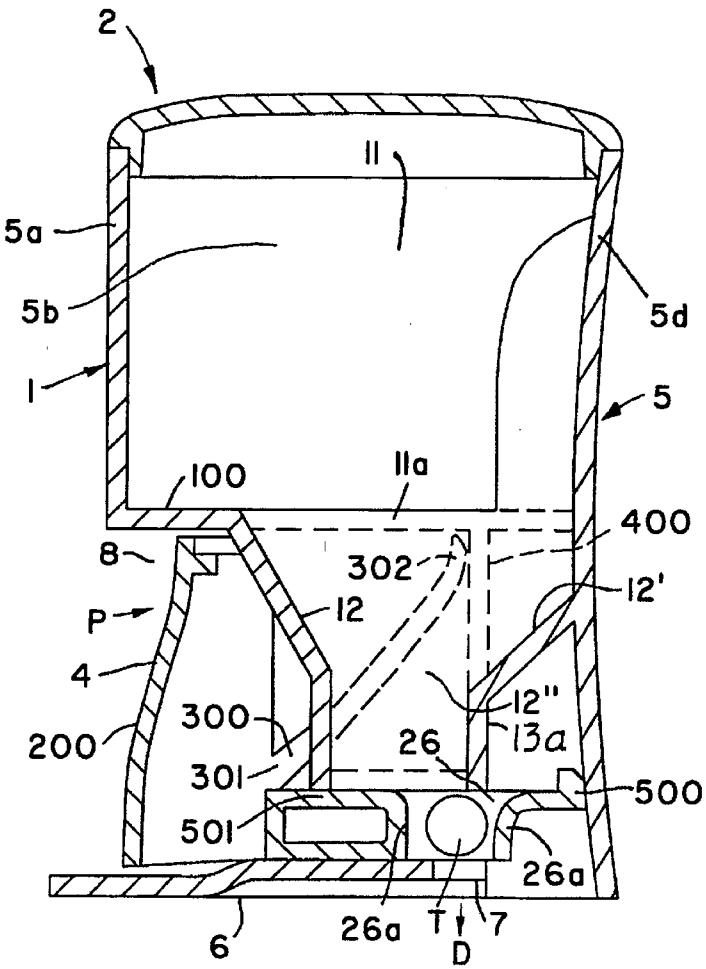
FIG. 11 PRIOR ART
FIG. 11 is a cross-sectional assembly view of a prior art device, in a dispensing position.
Figure 10:
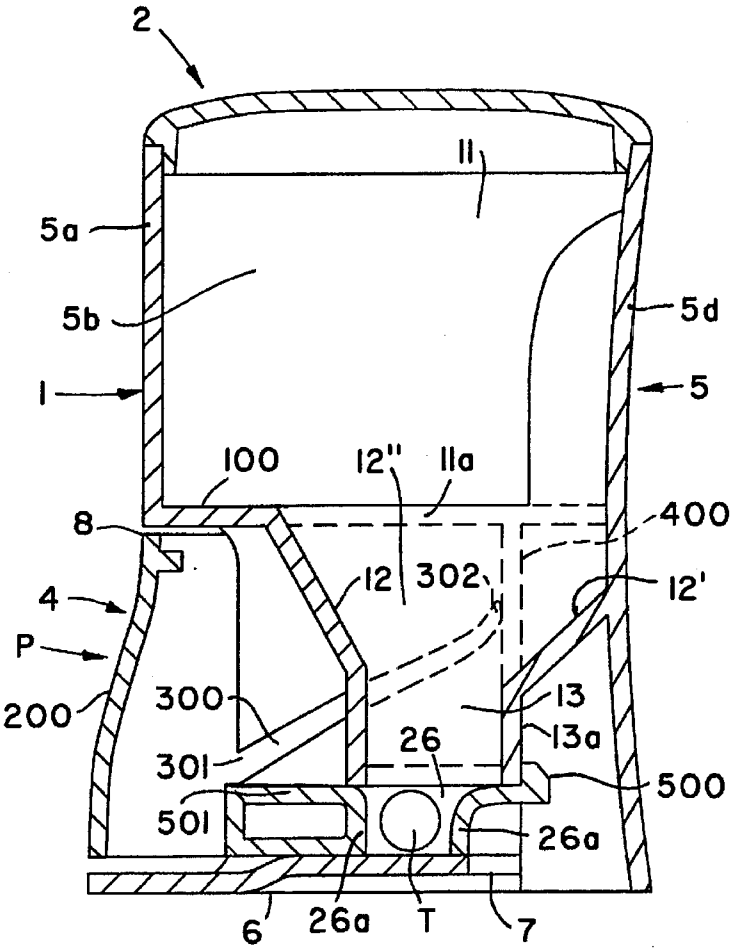
FIG. 10 PRIOR ART
FIG. 10 is a cross-sectional assembly view of a prior art device, in a non-dispensing position.

However, thumb or finger pressure in the direction P against thumbpad 200 causes thumbpad 200 and thumbpad spring section 203 to flex upwardly, disengaging locking pin or detent 601 from locking hole or recess 600. Thereafter, slider portion 4 can slide to the right (in FIGS. 8 and 9), against the bias of spring fingers 300 pushing against vertical walls 400. The slider portion 4 thus slides to the position of FIG. 11, such that tablet chamber 26 is immediately above tablet dispensing opening 7. Tablet T contained within tablet chamber 26 thereafter falls from tablet chamber 26 under the force of gravity, and thus the dispenser dispenses a single tablet in the direction D. An upper wall 501 on slider portion 4 closes off tablet outlet 13, to thereby prevent additional tablets in body portion 1 from being dispensed from the dispenser. Thumb or finger pressure is then released from thumbpad 200. The biasing force of spring fingers 300 causes slider portion 4 to move horizontally to the left in FIGS. 8 and 9, returning the slider portion 4 to the position of FIG. 10. The internal bias of thumbpad spring section 203 will snap locking pin or detent 601 into locking hole or recess 600 once slider portion 4 slide back to a position where locking pin or detent 601 is located over locking hole or recess 600. In the position of FIG. 8, a tablet T can drop into tablet chamber 26 for subsequent dispensing.

While the invention has been described in the specification and illustrated in the drawings with reference to preferred embodiments, it will be understood by those skilled in the art that various changes may be made and equivalents may be substituted for elements of the invention without departing from the scope of the claims.

I claim:

1. A child-resistant dispenser for dispensing tablets one at a time which comprises:

an outer casing comprising a reservoir, a lower wall, a dispensing opening in said lower wall and a locking recess;

a slider mechanism, said slider mechanism comprising a tablet chamber, said slider mechanism being moveable within said outer casing from a first position, in which said tablet chamber is aligned with said lower wall, and a second tablet dispensing position, in which said tablet chamber is aligned with said dispensing opening, said slider mechanism comprising a movable thumbpad, said movable thumbpad being connected to a locking detent, said movable thumbpad being movable from a locking position, wherein said locking detent is engaged with said locking recess to an unlocking position wherein said locking detent is disengaged from said locking detent.

2. The child-resistant dispenser of claim 1, further comprising:

a biasing element biasing said slider mechanism towards said first position.

3. The child-resistant dispenser of claim 1, wherein:

said locking detent comprises a pin.

4. The child-resistant dispenser of claim 1, wherein:

said locking recess comprises a hole in said lower wall.

5. The child-resistant dispenser of claim 1, wherein:

said movable thumbpad is mounted on a spring member biasing said locking detent toward said locking position.

6. The child-resistant dispenser of claim 1 wherein:

said movable thumbpad is recessed from an outer surface of said slider.

7. The child-resistant dispenser of claim 2, wherein:

said biasing element comprises two spring fingers.

8. The child-resistant dispenser of claim 6, further comprising:

a retaining latch mounted on said slider mechanism, said retaining latch retaining said slider mechanism in said outer casing.

9. The child-resistant dispenser of claim 8, wherein:

said retaining latch has an angled face.

10. The child-resistant dispenser of claim 1, further comprising:

a lid for said reservoir.

11. The child-resistant dispenser of claim 10, wherein:

said lid is mounted to said outer casing by an integrally molded hinge portion.

12. The child-resistant dispenser of claim 5, wherein:

said spring member is cantilevered.

* * * * *